US008303050B2

(12) United States Patent
Hahn

(10) Patent No.: US 8,303,050 B2
(45) Date of Patent: Nov. 6, 2012

(54) DEVICE FOR DISPLAYING OBJECTS

(75) Inventor: Thomas Hahn, Frankurt am Main (DE)

(73) Assignee: Glasbau Hahn GmbH, Frankfurt am Main (DE)

( * ) Notice: Subject to any disclaimer, the term of this patent is extended or adjusted under 35 U.S.C. 154(b) by 454 days.

(21) Appl. No.: 12/451,238

(22) PCT Filed: May 3, 2007

(86) PCT No.: PCT/EP2007/003891

§ 371 (c)(1),
(2), (4) Date: Nov. 2, 2009

(87) PCT Pub. No.: WO2008/135058

PCT Pub. Date: Nov. 13, 2008

(65) Prior Publication Data

US 2010/0127603 A1 May 27, 2010

(51) Int. Cl.
*A47F 3/00* (2006.01)

(52) U.S. Cl. ..... 312/139.2; 312/275; 312/296; 312/301; 312/319.5; 312/350

(58) Field of Classification Search ..... 312/114, 312/138.1, 139.2, 294, 296, 301, 275, 319.5, 312/350, 205

See application file for complete search history.

(56) References Cited

U.S. PATENT DOCUMENTS 2,141,468 A * 12/1938 Hamaker ..... 312/140.2
5,069,512 A * 12/1991 Sykes ..... 312/139.2
5,125,726 A * 6/1992 Hahn et al. ..... 312/114
5,435,644 A * 7/1995 Schuh et al. ..... 312/257.1
5,524,977 A * 6/1996 Orawski ..... 312/114
5,549,372 A * 8/1996 Lewis ..... 312/114
5,558,416 A * 9/1996 Dumitru ..... 312/139
5,820,233 A * 10/1998 Hahn ..... 312/114

(Continued)

FOREIGN PATENT DOCUMENTS

| | | |
|---|---|---|
| DE | 20 2006 01755 | 2/2007 |
| EP | 0 670 405 A1 | 9/1995 |
| EP | 0 775 459 A1 | 5/1997 |
| GB | 2 292 934 A | 3/1996 |
| WO | WO 02/00067 A | 1/2002 |

OTHER PUBLICATIONS

International Search Report.

*Primary Examiner* — Hanh V Tran
(74) *Attorney, Agent, or Firm* — Bucknam and Archer

(57) ABSTRACT

A display case having a preferably square or rectangular outline and a front (1), a rear (2), an upper (5), a right (3) and a left side face (4), a base (6) or in addition an upper part (14) instead of the upper side face (5), all the side faces or at least a part of the same being formed of panes of glass, the interior being sealed in its lower region with a support surface (7) and the display case being sealed extensively in an airtight manner relative to the external air. The display case being formed from two symmetrical halves (8, 9) which are separated from each other vertically, the base (6) and the possibly present upper part (14) forming a part of the front (1), rear (2), right (3) and left side face (4) and the two halves (8, 9) being able to be moved away from each other or towards each other horizontally and parallel, the support surface (7) being excluded from the movement. Such a display case has no door, access to the interior is nevertheless provided in the open state.

10 Claims, 4 Drawing Sheets

U.S. PATENT DOCUMENTS

Figure 1:
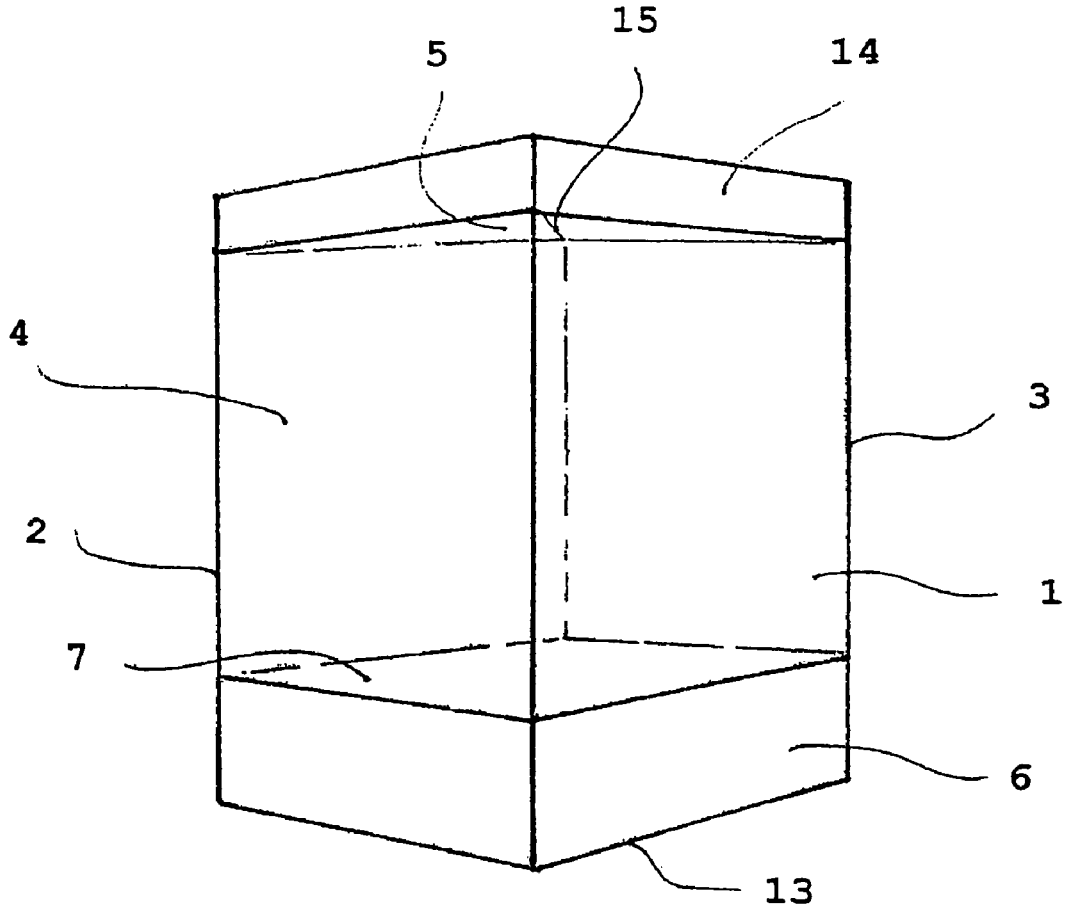

| | | | | |
|---|---|---|---|---|
| 6,378,962 | B1 | 4/2002 | Green | |
| 6,398,322 | B1 * | 6/2002 | Chaplin | 312/140 |
| 2002/0104839 | A1 | 8/2002 | Hsiao | |
| 2005/0001520 | A1 | 1/2005 | Cummings | |
| 2006/0001336 | A1 * | 1/2006 | Lupo | 312/205 |
| 2006/0028102 | A1 * | 2/2006 | Hahn | 312/139.2 |
| 2008/0252188 | A1 * | 10/2008 | Nielsen | 312/205 |
| 2009/0102331 | A1 * | 4/2009 | Goppion | 312/116 |

* cited by examiner

DEVICE FOR DISPLAYING OBJECTS

CROSS REFERENCE TO RELATED APPLICATIONS

This application is the National Stage of PCT/EP2007/003891 filed on May 3, 2007. The international application under PCT article 21(2) was not published in English.

The invention relates to a device for displaying or storing objects, having a preferably square or rectangular outline and a front, a rear, an upper, a right and a left side face, a base or in addition an upper part instead of the upper side face, all the side faces or at least a part of the same comprising panes of glass, the interior being sealed in its lower region with a support surface and the device being sealed extensively in an airtight manner relative to the external air.

Access to the interior and in particular to the support surface of a device of this type, also termed display case, is effected generally by configuration of a side wall as a pivotable door. If now the interior of such a display case is intended to be sealed in as airtight a manner as possible relative to the environment, then difficulties occur if the seal of the door is effected by means of sealing lips and in fact in particular in the hinge region of the door since, at this point, the door is not moved in a straight line towards the sealing lip during the closing process. In EP 0 670 405 A1, a display case is described in which, by means of special measures, the door is moved towards the end of the closing process perpendicularly onto the sealing lips in the door opening.

Another solution for enabling access to the interior of a display case can also reside in the fact that the entire upper part is lifted in one piece from the support surface in that, at all four corners, respectively one electric spindle drive is used for lifting and lowering the upper part. A display case of this type is described for example in EP 0 775 459 A1.

Cleaning the insides of the side faces is disadvantageous in most known display cases since, in most cases, the displayed objects must be removed from the same in order that the inside of the side faces is freely accessible. In the case of many known display cases, the accessibility to the insides of the side faces is in addition often greatly restricted even when the display case is emptied as a result of the construction or structure of the same.

The object of the invention now resides in indicating a display case in which accessibility to the interior, in particular also for cleaning the insides of the side faces, is extensively made possible and the mentioned difficulties are furthermore avoided during sealing of the door.

This object is achieved in that the device comprises two symmetrical halves which are separated from each other vertically, the base and the possibly present upper part forming a part of the front, rear, right and left side faces, and in that the two halves can be moved away from each other or towards each other horizontally and parallel by suitable means, the support surface being excluded from the movement.

The display case according to the invention has no door and if the two halves in the open state of the display case are sufficiently far apart, access to the interior or to the support surface is made available. The sealing lips which are fitted on the touching edges of the two halves are guided towards each other in a straight line during the closing process as a result of the horizontal and parallel movement. In contrast to doors which are often without a frame for aesthetic reasons, the two halves represent a more stable arrangement, by means of which the display case according to the invention is also more burglar-proof. Since the two halves are moved away from each other and the support surface in contrast maintains its position, during cleaning of the insides of the side faces, the displayed objects remain in their place, whilst, on the other hand, these also do not impede the cleaning process.

A development of the invention resides in the fact that the separation line between the two halves extends in the diagonal of the outline. With this solution, the separation line between the two halves is not visible since these extend in the course of the line at which respectively two side faces of different halves abut against each other horizontally. Regarded optically, this part of the display case in the closed state does not differ from the corner connection of two side faces of one half.

Figure 2:
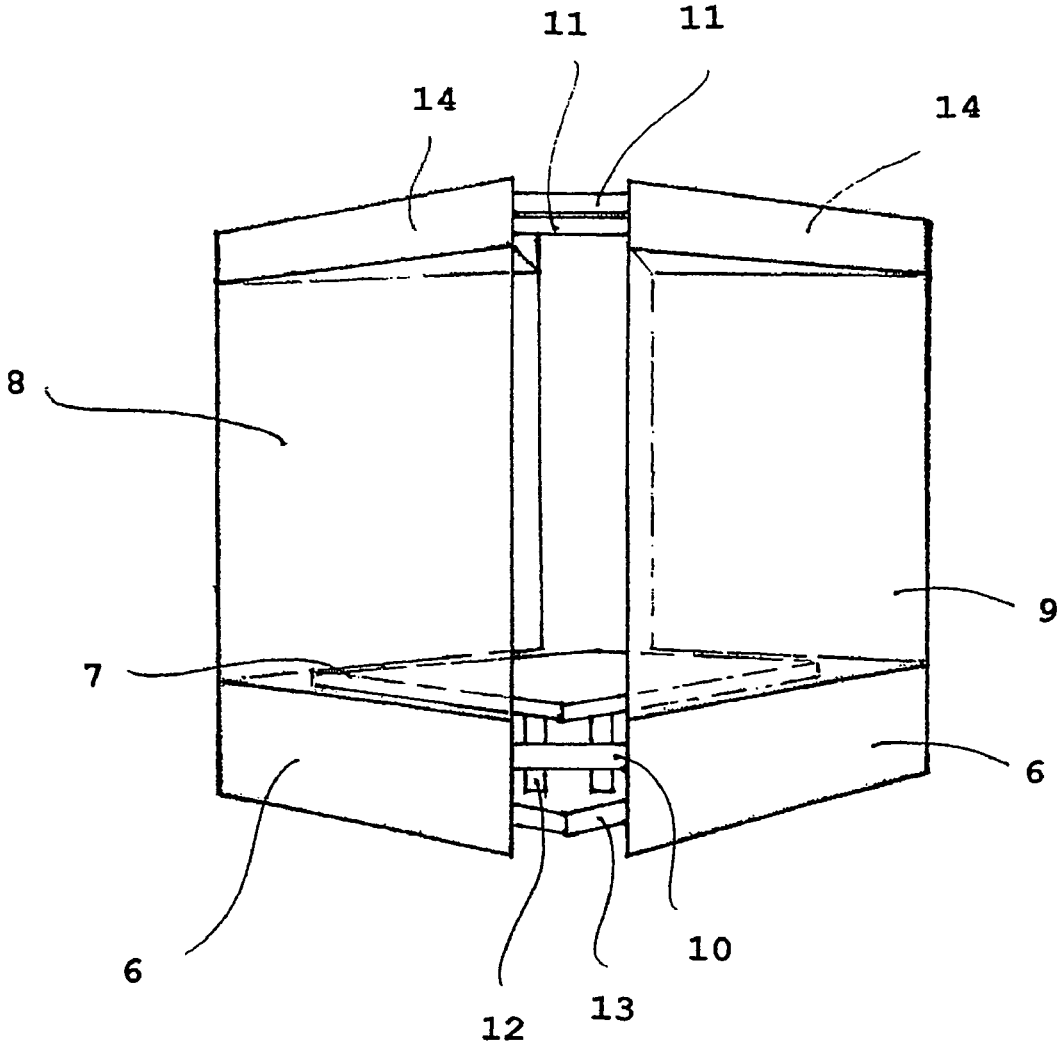
Figure 3:
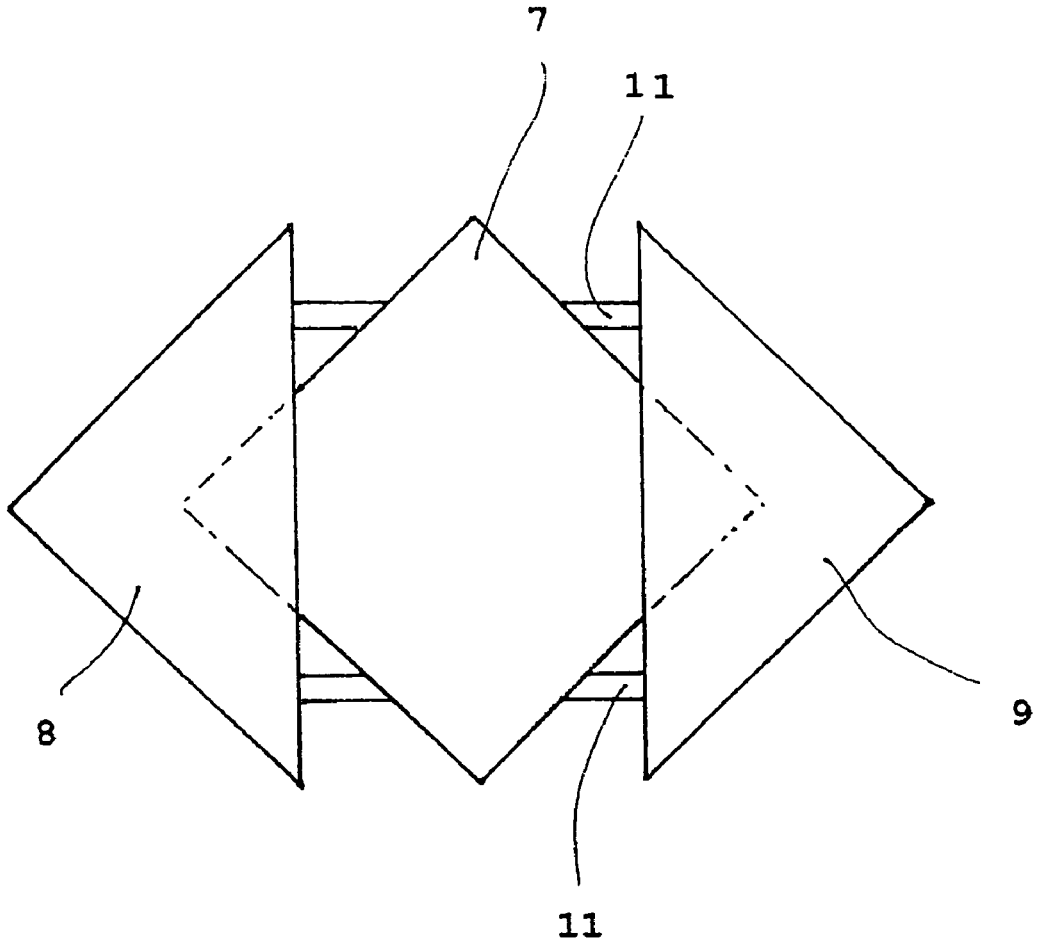

The invention is explained in more detail with reference to an embodiment which is represented in the drawing. There are shown:

FIG. 1 the display case in the closed state,

FIG. 2 the display case in the partially open state,

FIG. 3 a plan view of a completely open display case, and

Figure 4:
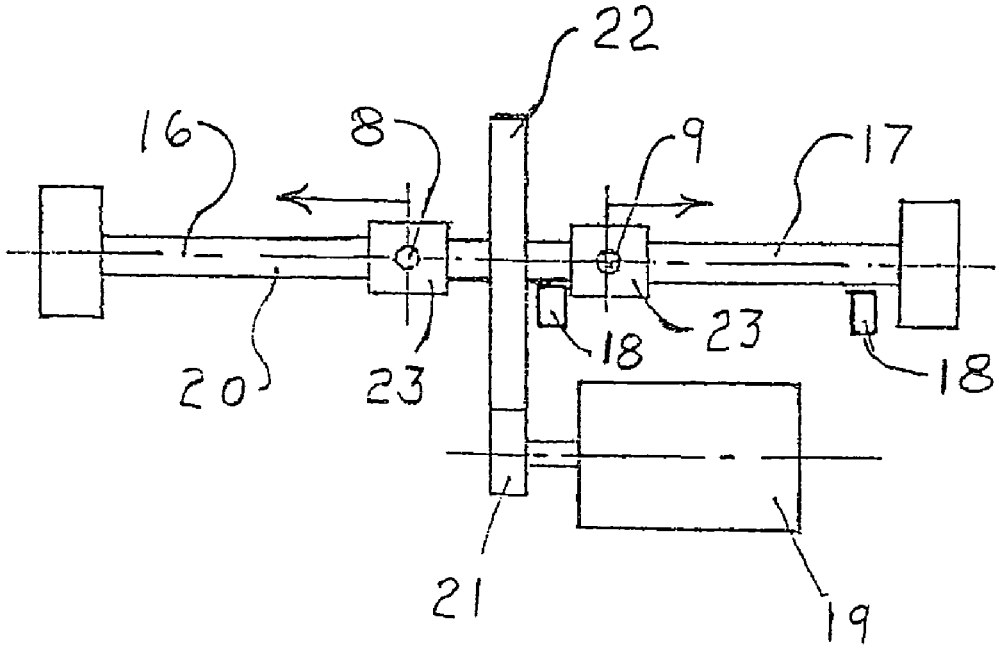

FIG. 4 the mechanical set-up for the drive of the two halves of the display case.

The display case shown in FIG. 1 has a square or rectangular outline but the invention can be applied also for a display case with for example a hexagonal outline. A front 1, a rear 2, a right 3 and a left side face 4 surround the space for receiving objects, the side faces being formed respectively from a transparent pane of glass. The lower part of the display case forms a base 6, on the upper side of which a support surface 7 is situated. At the top, the display case can be sealed by an upper side face 5 which likewise comprises a pane of glass. Instead of the upper side face 5, the display case can also have an upper part 14 in which for example an illumination device can also be accommodated. The display case stands for example with its underside 13 on a floor.

Each side part 1 to 4, together with the corresponding part of the base 6 and in the presence of the upper part 14, also together with the corresponding part of the upper part 14, forms one unit per se. This can take place for example in that the mentioned side parts 1 to 4 extend beyond the base 6 and possibly also beyond the upper part 5 and are configured respectively as a continuous pane of glass, the pane of glass being formed, in the region of the base 6 and of the upper part 5, by an opaque foil which is applied on the inside. The body of the display case is hence formed from the described side parts, respectively two adjacent side parts being connected to each other securely in pairs and consequently two oppositely situated halves being produced.

A separation line 15 which separates the entire display case into two symmetrical halves extends diagonally relative to the outline of the display case. According to FIG. 2, the display case comprises a first half 8 and a second half 9 which are both separated from each other vertically. The separation line 15 thereby extends on the abutting edge at which two side faces of different halves 8 and 9 abut against each other. It is also conceivable to have the separation line extend centrally through the square or rectangular outline but, in this case, the separation line extends vertically in the centre of two side faces and would be visible in the closed state of the display case, whilst, in the case of the diagonal separation line, the same coincides with the abutting edge of two side faces of different halves and hence is not more conspicuous than the abutting edge of two side faces of the same half.

The underside 13 of the display case is formed by a base plate on which an arrangement 12 is fitted on which the support surface 7 is mounted. Hence the support surface remains unchanged in its position when the two halves 8 and 9 are moved away from each other. The intermediate space between support surface 7 and base plate, in the closed state of the display case, is covered by the base 6. The arrangement 12 also serves for mounting the guide 10 and possibly 11 which enable the horizontal movement of the two halves 8 and 9. The guide 10 shown in FIG. 2 is fitted securely in pairs between the support surface 7 and the base plate on the arrangement 12, as a result of which a parallel movement of the two halves 8 and 9 away from each other or towards each other is achieved. The other guide 11 is likewise present in pairs and is mounted either in the upper part 14 or, when the upper part 14 is not present, likewise in the base 6 and in fact above the guide 10 on the arrangement 12 and parallel to the latter. The guides 10 and 11 are orientated parallel to the underside 13 and at an angle of 90 degrees to the separation line 15. The entire weight of both halves 8 and 9 rests upon the guides 10 and 11. In the case of display cases with large dimensions and hence also great weights, it can be expedient to provide the two halves 8 and 9 with rollers on the underside 13 thereof in order to relieve the guides 10 and 11 with respect to weight.

The guides 10 and 11 respectively comprise a stationary and a moveable part, the stationary part being connected securely to the arrangement 12 and the moveable part to a half 8 or 9. The moveable part is mounted displaceably in the stationary part, as a result of which a movement of one half 8 or 9 is made possible. Hence at least 4 guides are required if the stationary part has a length which allows a wide opening between the two halves 8 and 9, the stationary part being used in common by the moveable parts of two halves. The stationary part can also have a telescopic extension which is only extended if the moveable part abuts against the end of the stationary part. If the stationary part is used in common by two moveable parts then a telescopic extension must be provided at both ends. The stationary part of the guides 10 and 11 can have a U-shaped configuration for example, the latter receiving a moveable part which has a large number of rotatable rollers connected to each other. However also other guides are conceivable in which, instead of rollers, also balls enable the sliding movement of the moveable part in the stationary part of a guide 10 and 11.

As clearly seen in FIG. 4 , an electric motor 19 can be mounted on the stationary part of the guides 10 and 11, said electric motor driving via a gear consisting of pinion 21 and 22 a threaded spindle 20 on which a threaded sleeve 23 is situated and being connected securely to one half 8 or 9. In this way, a push-pull movement can be achieved by the electric motor 19, which results in pulling apart or pushing together of the two halves 8 and 9. It is also conceivable to provide respectively only one electric motor 19 for one pair of guides 10 or 11, said electric motor driving a threaded spindle 20, one half of which is provided with a normal thread 16 and the other half of which with a counter-thread 17, as a result of which the simultaneous movement of the two halves 8 and 9 outwardly or inwardly is made possible. The threaded spindle 20 in this case would have to be fitted in the course of the connection line between the corners of the two halves 8 and 9 on the arrangement 12 or in the upper part 14, i.e. at an angle of 90 degrees to the separation line 15. Absolute synchronisation of all the electric motors is a prerequisite for uniform movement of the two halves 8 and 9. This is achieved by control of the same by means of an electronic control device (not shown to which the electric motors are connected electrically. Sensors 18 which signal the closed state and the end state of the opening between both halves 8 and 9 are likewise connected to the electronic control device, as a result of which the electronic control device is caused to terminate the operation of the electric motors. It is also conceivable to cause the process of opening and closing of the display case without wires in the electronic control device by means of a remote control.

According to the size of the display case, it can also be necessary, instead of the four guides 10 and 11, also to use further guides of this type.

In FIG. 3, a display case according to the invention is shown in the end position of the open state. It is thereby assumed that the latter has a transparent upper side face 5. The two halves 8 and 9 are moved away from each other to such an extent that access to the support surface 7 is made available, in addition the spacing of the two halves 8 and 9 is also sufficient such that the insides thereof are freely accessible for cleaning, the objects situated on the support surface 7 not impeding the cleaning.

It is also conceivable not to fit the two halves 8 and 9 in a stationary manner but respectively rotatable horizontally on the moveable part of the guides 10 and 11. As a result, it becomes possible to end the pushing apart of the two halves prematurely in the one guide, whilst the pushing apart of the two halves in the oppositely situated guide is continued until the end position. In this way, the opening between two halves 8 and 9 on this side is enlarged, the oppositely situated opening being opened only so far that the two halves 8 and 9 do not touch. As a result of this configuration of the display case for which corresponding measures must be adopted in the control device for the different course of the motors, the telescopic extension of the guides 10 and 11 can possibly be dispensed with.

Sealing lips are fitted in the region of the separation line 15 on the one of the two halves 8 or 9.

Reference Numbers

1 front side face
2 rear side face
3 right side face
4 left side face
5 upper side face
6 base
7 support surface
8 first half
9 second half
10 first guide
11 second guide
12 arrangement
13 underside
14 upper part
15 separation line

The invention claimed is:

1. A device for displaying or storing objects, having a preferably square or rectangular outline and a front, a rear, a right and a left side face, a base and an upper part, all the side faces or at least a part of the same comprising panes of glass, the interior being sealed in its lower region with a support surface and the device being sealed extensively in an airtight manner relative to the external air, characterised in that the device comprises two symmetrical halves (8, 9) which are separated from each other vertically, the base (6) and the upper part (14) forming a part of the front (1), rear (2), right (3) and left side face (4), and wherein the two halves (8, 9) are adapted to be moved away from each other or towards each other horizontally and parallel by suitable means, the support surface (7) being excluded from the movement.

2. The device according to claim 1,
characterised in that
the separation line extends between the two halves (8, 9) in the diagonal of the outline.

3. The device according to claim 2,
characterised in that
the two halves (8, 9) are fitted moveably on guides (10, 11) which are accommodated in pairs in the interior of the base (6) and within the upper part (14).

4. The device according to claim 3,
characterised in that
an arrangement (12) is present in the interior of the base (6), to which arrangement the guides (10, 11) and the support surface (7) are connected securely.

5. The device according to claim 4,
characterised in that
the arrangement (12) is connected securely to a base plate of the device forming the underside (13).

6. The device according to claim 5,
characterised in that
the guides (10, 11) are fitted securely on the arrangement (12), the orientation being effected parallel to the underside (13) and at an angle of 90 degrees to the separation line (15).

7. The device according to claim 6,
characterised in that
the guides (10, 11) comprise a stationary and a moveable part, the stationary part being connected securely to the arrangement (12) and the two halves (8, 9) being mounted displaceably in the stationary part as a moveable part.

8. The device according to claim 7,
characterised in that
the stationary part has a telescopic configuration.

9. The device according to claim 8,
characterised in that respectively one drive (16, 17, 21, 22, 23) which is operated by an electric motor (19) is fitted on the stationary part of the guides (10, 11), by means of which drive the moveable part of the guides (10, 11) can be moved.

10. The device according to claim 1,
characterised in that
sealing lips are fitted on the one of the two halves (8, 9) in the region of the separation line.

* * * * *